US007607513B1

(12) United States Patent
Rojas

(10) Patent No.: US 7,607,513 B1
(45) Date of Patent: Oct. 27, 2009

(54) TELESCOPING LIFTING HAND TRUCK WITH A FOLDING PLATFORM

(76) Inventor: Elmo Rojas, 47 Sicomac Ave., Midland Park, NJ (US) 07432

( * ) Notice: Subject to any disclaimer, the term of this patent is extended or adjusted under 35 U.S.C. 154(b) by 0 days.

(21) Appl. No.: 11/998,364

(22) Filed: Nov. 29, 2007

(51) Int. Cl.
*E04G 1/22* (2006.01)

(52) U.S. Cl. ..... 182/20; 182/69.4; 182/69.6; 182/141

(58) Field of Classification Search ..... 182/20, 182/27, 69.4, 69.6, 124, 130, 141, 131, 223, 182/222, 150, 152; 187/242–244; 108/169, 108/174, 147.19, 147.21
See application file for complete search history.

(56) References Cited

U.S. PATENT DOCUMENTS 2,428,184 A * 9/1947 Swindler ..... 182/69.4
2,556,611 A * 6/1951 Borgman ..... 182/186.6
3,516,512 A * 6/1970 Handschack et. al. ..... 182/16
3,521,775 A * 7/1970 Vermette ..... 414/495
3,907,066 A * 9/1975 Newton ..... 182/112
3,927,732 A * 12/1975 Ooka et al. ..... 182/36
4,258,825 A * 3/1981 Collins ..... 182/14
4,987,976 A * 1/1991 Daugherty ..... 187/243
5,732,792 A * 3/1998 White ..... 182/62.5

* cited by examiner

*Primary Examiner*—Katherine W Mitchell
*Assistant Examiner*—Colleen M Quinn

(57) ABSTRACT

A hand truck having a folding platform attached to a wheeled base. The base having an arrangement of stabilizing bars and feet and vertically extensible masts that raise and lower the folding platform by operation of a motor attached to the base. The platform of the hand truck, when in the extended position, has modular removable railings attached along the perimeter of different platform sections. The platform is collapsible about pivot pins and suspended by chains attached to brackets atop the extensible masts.

1 Claim, 14 Drawing Sheets

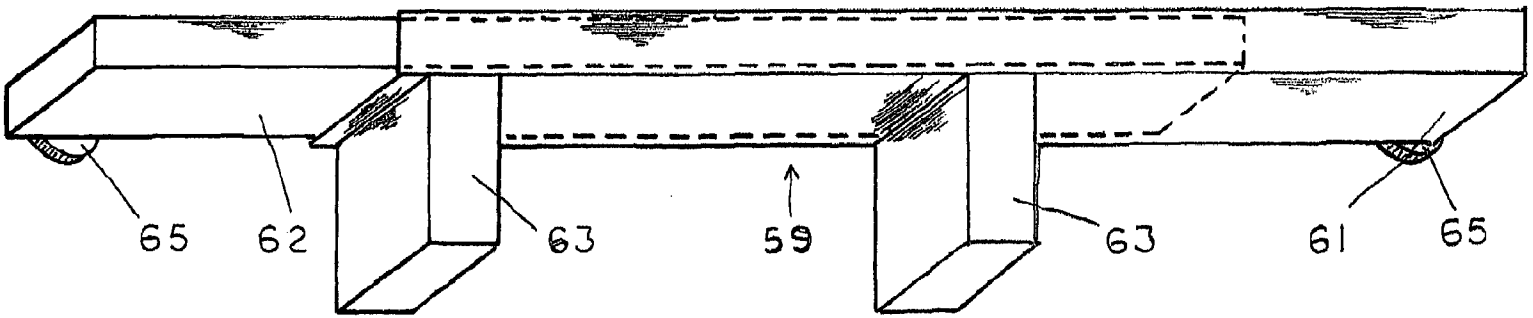
FIG. 15
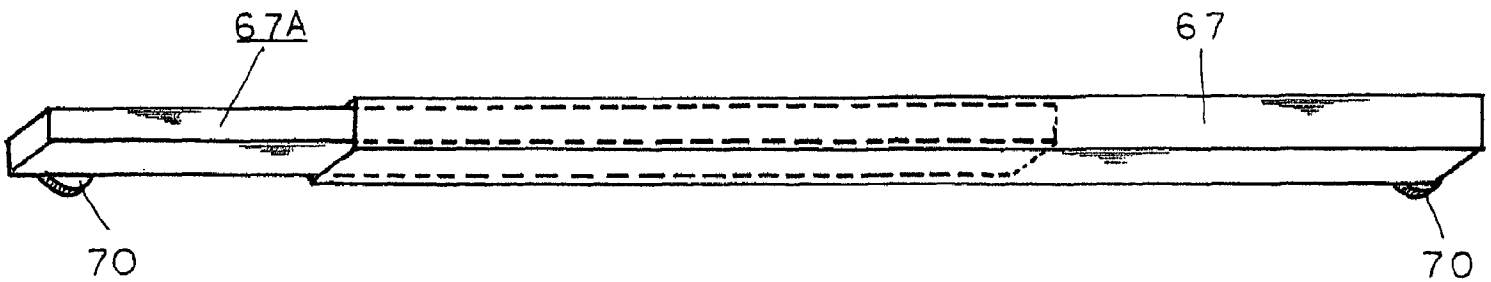
NEW FIG 16

TELESCOPING LIFTING HAND TRUCK WITH A FOLDING PLATFORM

FEDERALLY SPONSORED RESEARCH

No Applicable

SEQUENCE LISTING PROGRAM

No Applicable

BACKGROUND

1. Field of Invention

This invention relates to new and compact use-full improvements lifting hand truck 2. Prior Art This invention is an improvement over all others lift hand trucks telescoping apparatus, every lifts are very heavy and difficult to get carried away to transport, the platform they are small is too difficulty to get carrying two or more persons and heavy apparatus or materials another disadvantage is the conventional cable winch drive that result an uneven progression of spiral as the cable is wound on the winch drum. This action results in cable pile-up and damage.

The present invention relates to a lifting apparatus capable of raising operator, helpers and materials all together at the same time to an elevate location, for assembling, construction, painting, repairing, maintaining, include hunting.

SUMMARY

The present invention is a lift truck utilizing plurality mast an very longer folding platform with an electrically operated and controlling from the platform. The longer folding platform have three sections, one in movable platform base, one in the from another in the back of movable platform base. The two sections of platform from and the back have three railing each.

Another object of the present invention is the safety at the moment when the railing is used, this is movable from the platform said platform have three railing, if the platform is close to the wall take out one railing close to the wall for better work.

Another railing is joined to the side railing for hinges, in the upper side to support to the movable platform base.

Another safety is in each vertical post and the movable platform base have a latch.

Another object of the present invention is which is that provide stability to attach rectangular tube in the base.

Another object to this invention is the light weight easy to transport.

Another object of the present invention is controlled by a driver situated on the platform lifting to handle to raise or to lower in any altitude which he like.

Another object of present invention is to make more compact at to take up two platform foldables in extreme opposite to main platform to stay vertically for what rotating in the pins or bolts what have in common said main platform and foldables platforms, said two foldables platforms to being joined in the upper with the mast and to tie and is easy to move and storage.

Another advantages of this invention is for the function that full-fill the joint of fixed and movable pulleys in joint of a cable is that the are simple machine and simple machines multiply effort and get large mechanical advantage.

Another objects and advantages of this invention will become more apparent after a more careful study of the following detailing description which is to be read with reference to the accompanying drawings wherein is illustrated and preferred embodiment of my invention.

DRAWINGS

Figures

FIG. 15 is a perspective of optional piece for stability of telescoping lift hand truck, FIG. 16 is a perspective of optional piece for stability of telescoping lift hand truck, this part inside in the part is the stationary base;

DETAILED DESCRIPTION

Figure 1:
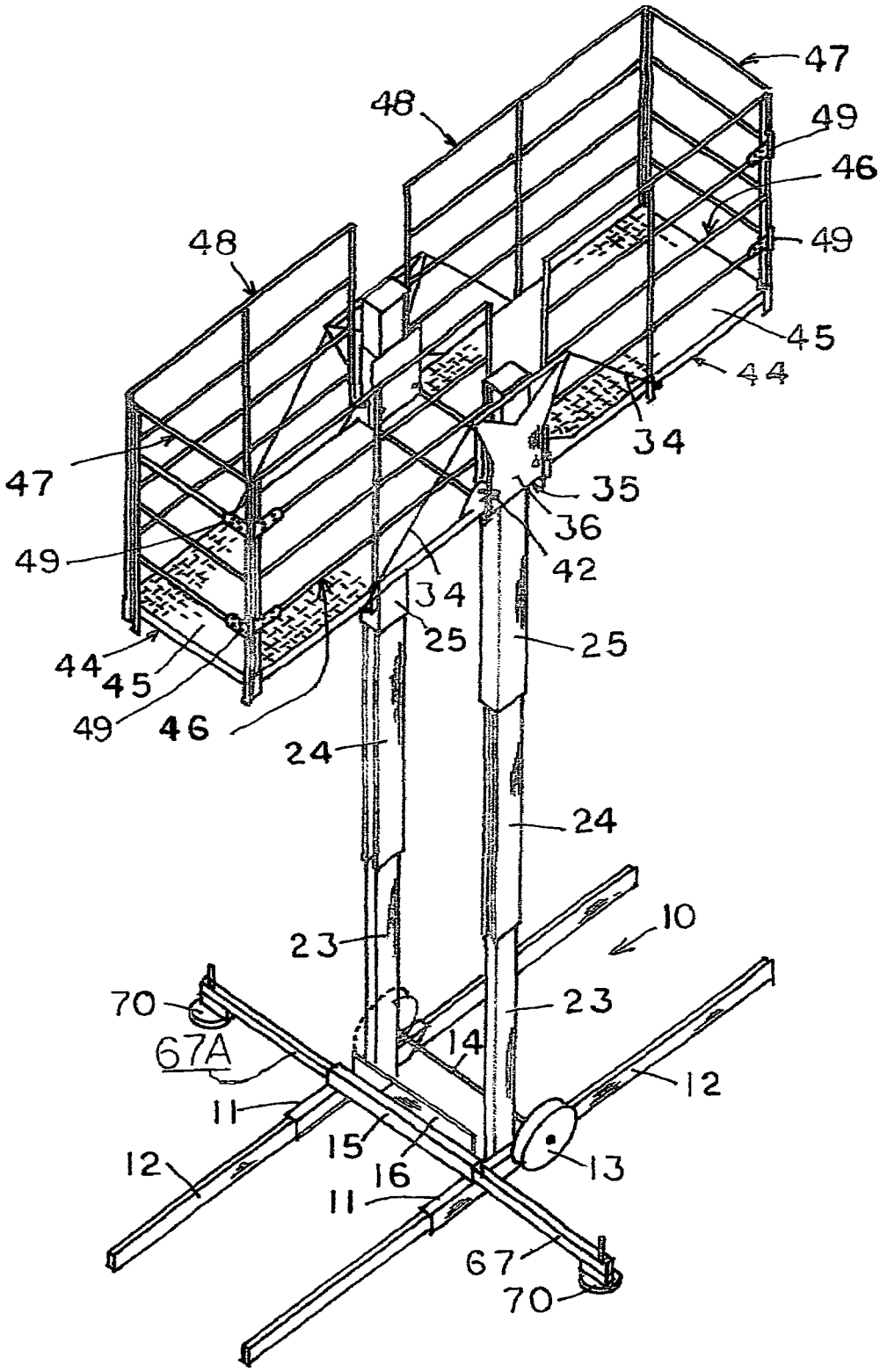
FIG. 1 is a perspective view of Telescoping lift hand embodying the present invention.

The preferred embodiment of hand truck with telescoping elevator and folding platform will be described with reference to FIGS. 1 to 7.

The present invention comprises a base stationary 10 whereby the base 10 move only if inclined to side of the wheels 13. The base 10 include pair the base side members 11. This base is a rectangular tub and support a base cross member 15, a vertical plate 16, an axle 14 and two stationary mast 23 is welding to the base side member 11. The base cross member 15 is rectangular tube and go over two base side member 11 to welded, this base cross member 15 support vertical plate 16. The vertical plate 16 is welded to the base cross member 15 and in the side of the base side member 11. This vertical plate 16 support the motor 66 in the base cross member 15 inside optional piece for stability 67 and 67A This base cross member 15 support the axle 14 this axle 14 support in the end the wheels 13.

In the base side member 11 enter rectangular tube 12 for more stability, this rectangular tub 12 is the less thickness the base side member 11

The base cross member 15 enter a rectangular tube 67 for more stability and inside this rectangular tub 67 have another rectangular tube 67A of less thickness. If the machine is close to the wall, the piece 67A can be remove or regulated Each base side member 11 have fixed to a mast 23, and this mast 23 is stationary, and vertical. This mast 23 is inside the another mast movable 24, and this mast 24 is inside the another mast movable 25, The movable platform base 35 support the folding platform 44 in this lower extreme for two pin 42, the pin 42 connect the lower side of the movable platform base 35 to one extreme of platform 44, also this movable platform base 35, support from the upper side to the center o between center and extreme opposite to the pin 43 in the upper side of movable platform base 35, have one shackle 43 in this piece inside one chain 34 an support platform 44.

This portion of platform 44, have three railing 46, 47, 48, two railing 46, 47, joined for hinges 49, the another railing 48 is free for take out easy, if the work is close to wall. The railing 46, and other 48, is supported for portion of platform 44 in three vertically square tub in the extreme and center 50, this is more broad of the railing 46, 47, 48, and for stability used the upper outside part 36 of the platform, 44 is shown better in FIG. 2.

Figure 3:
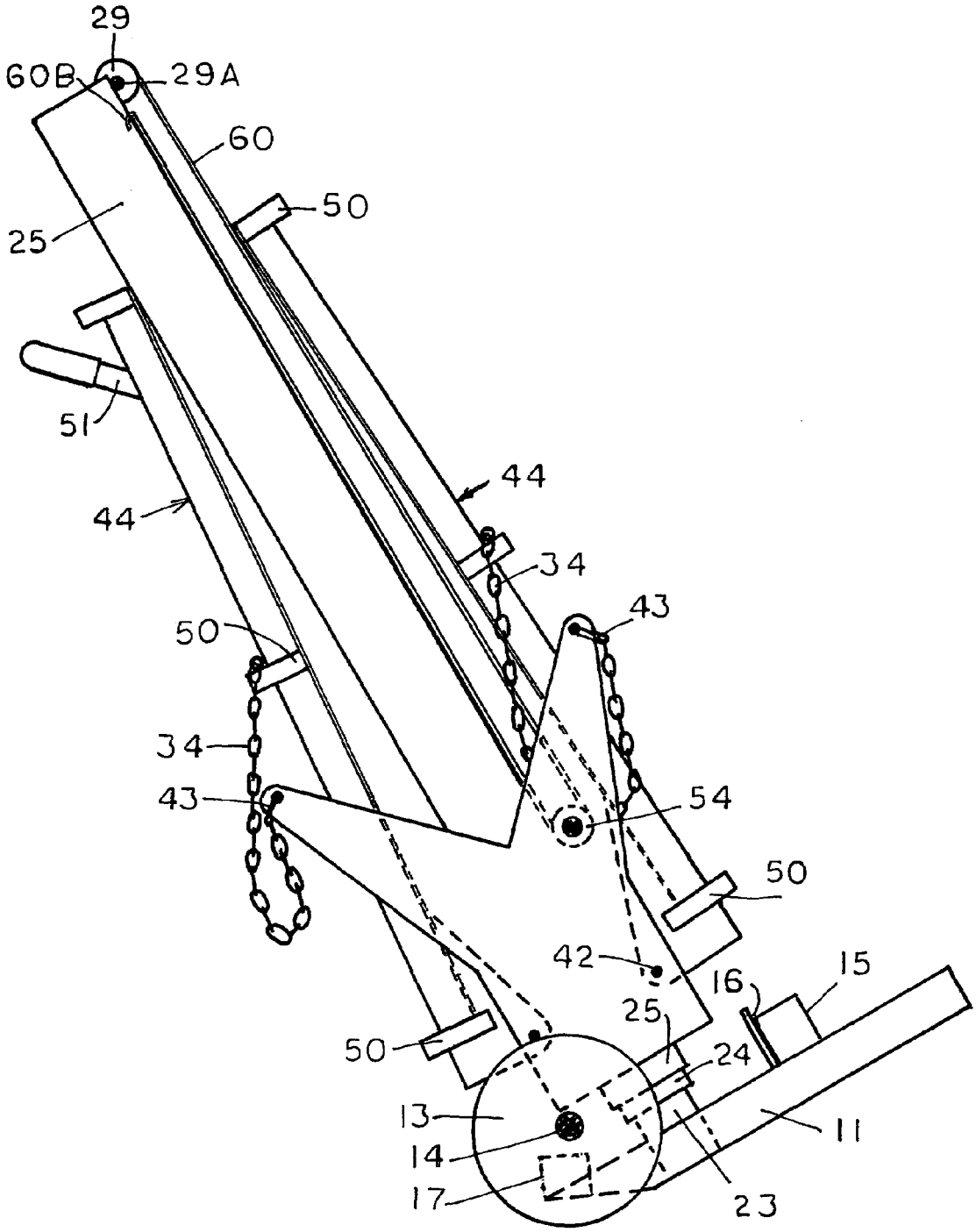
FIG. 3 is a side elevational view of the telescoping lift hand truck shown in position inclined for easy to move.

FIG. 3 illustrates the lift in position inclined easy to move an storage or transport. This don't have the bars for stabilized 12 in this moment the platform 44 is move over axis 42 and put in position joined to the mast 25 afterwards to tie two portion of the platform one folding platform 44 have two handles 51.

Figure 4:
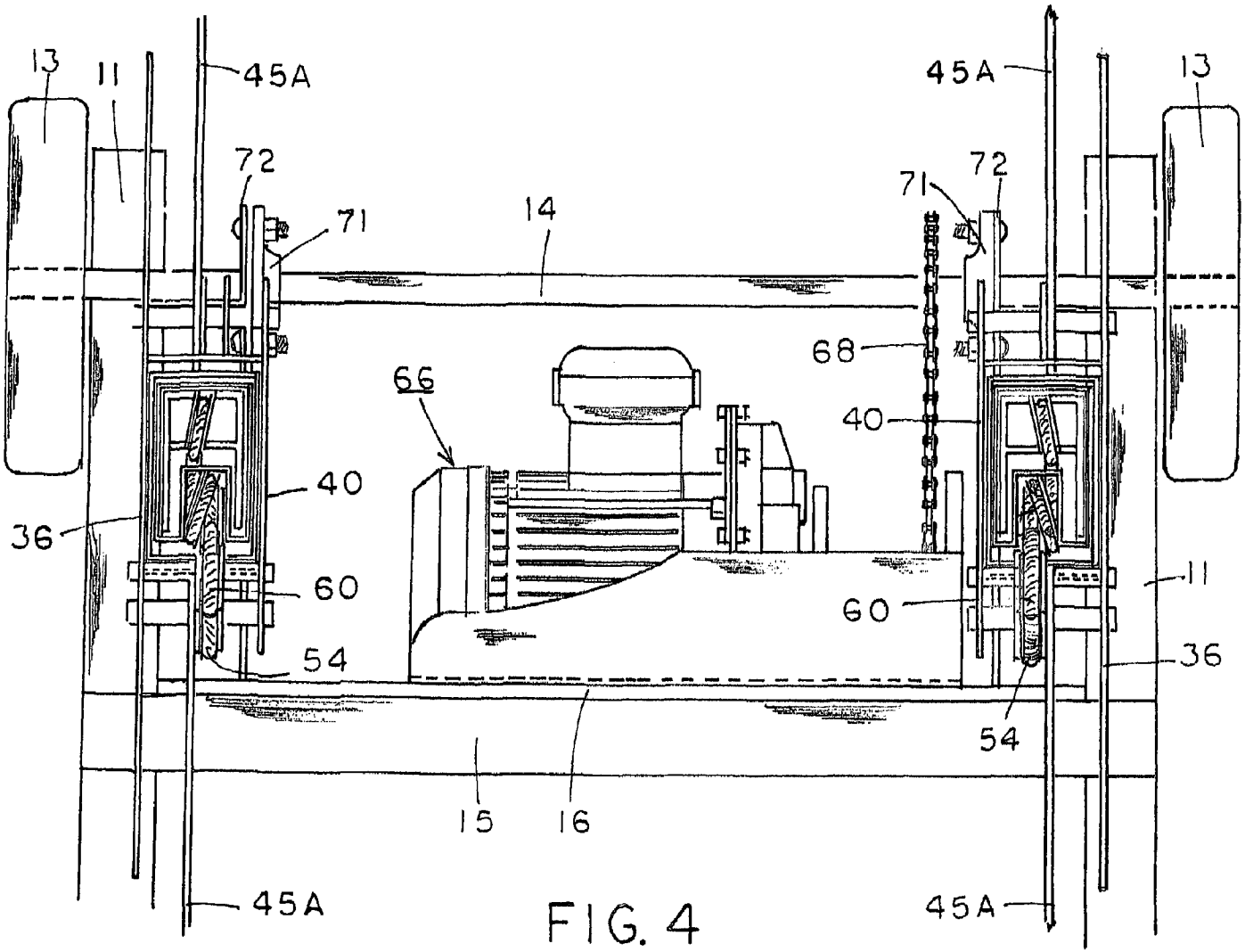
FIG. 4 is a plan view in lower position of the telescoping lift hand truck and have partial platform.

FIG. 4 shows all parts and illustrates the motor 66, masts 23, 24, 25 axle chain 68, cross member 15, cross plate is and wheels 13.

Figure 5:
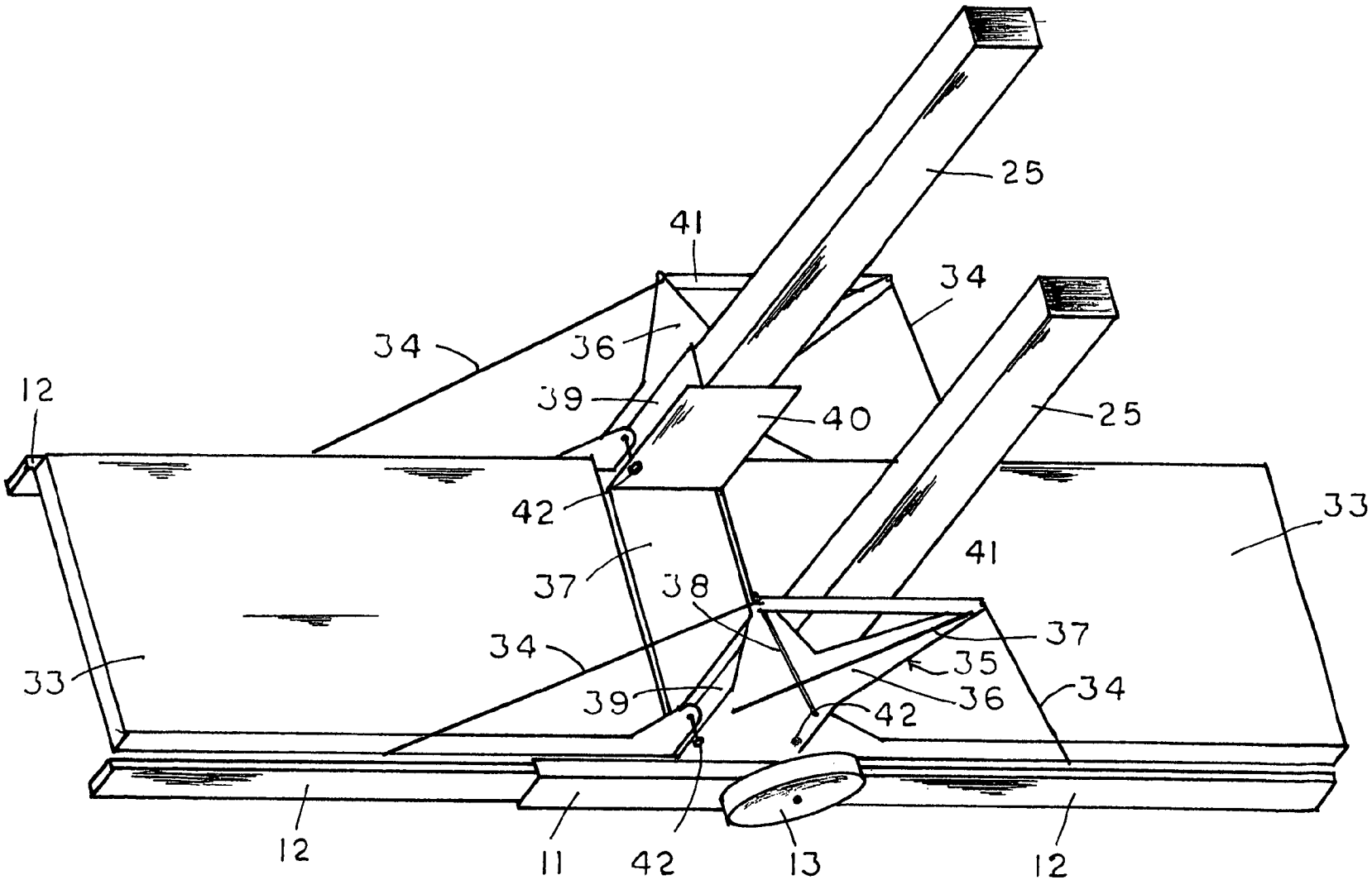
FIG. 5 is a perspective view in lower position of the telescoping lift hand truck and no have railing

FIG. 5 is when star to assembly the lift hand truck.

Figure 6:
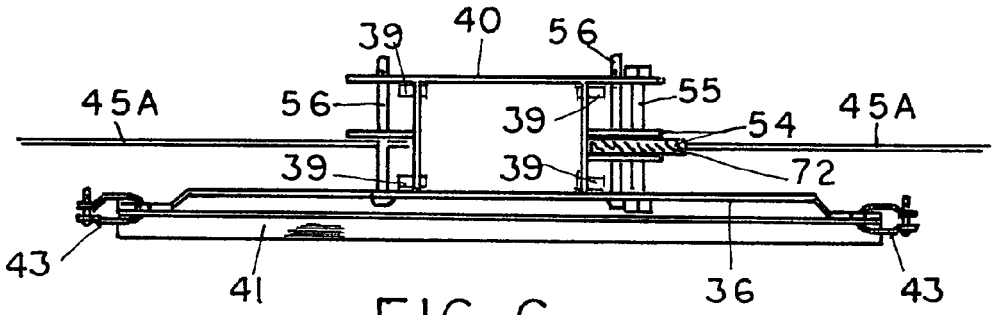
FIG. 6 is a top plan view of the movable platform base of the telescoping lift hand truck, this is only one side.
Figure 7:
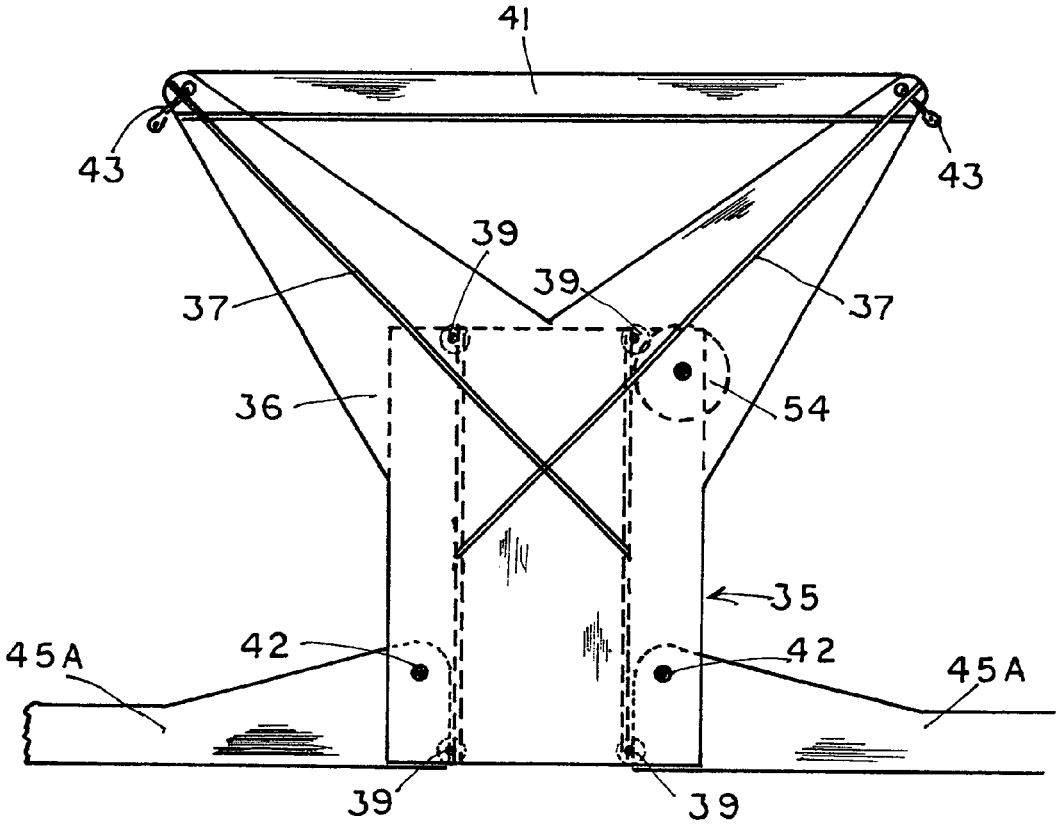
FIG. 7 is a said view of the movable platform base of the telescoping lift hand truck.

FIGS. 6 and 7 is a movable platform base 35 and have part of portion the platform 45A and is reinforced for 41 and 37, also have shackle 43, pulley 54 and the pin 42 for support the folding platform.

Figure 8:
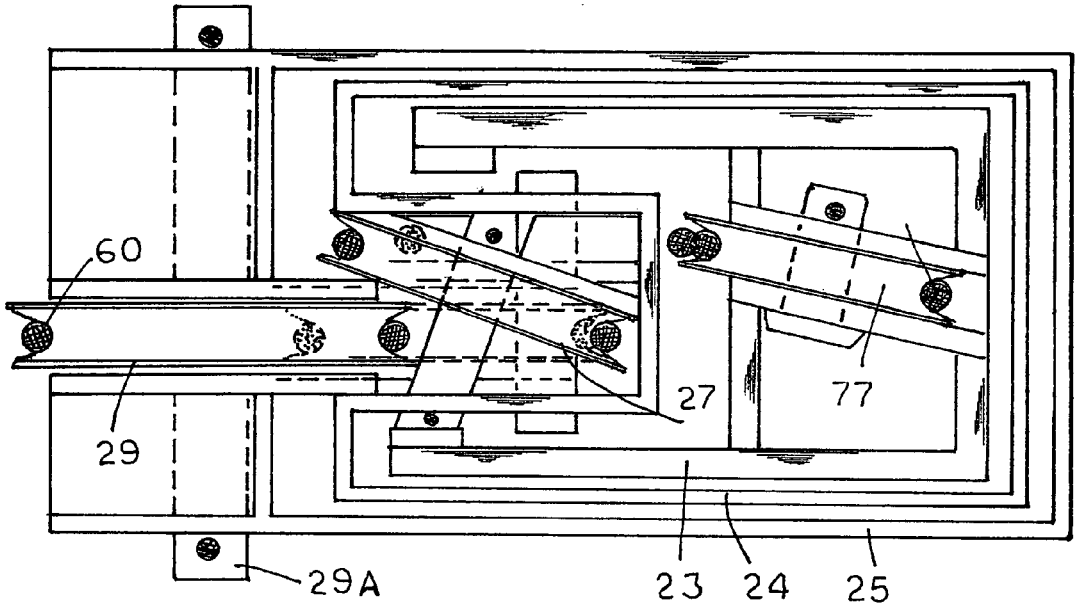
FIG. 8 is a tap plan view of the right plurality mast of the telescoping lift hand truck.
Figure 9:
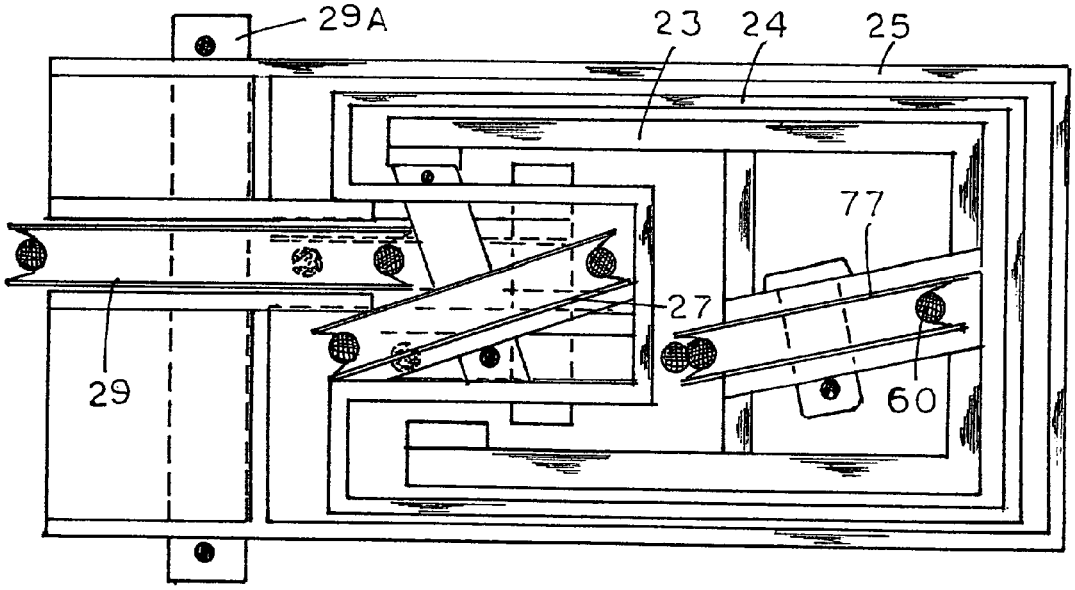
FIG. 9 is a top plan view of the left plurality mast of the telescoping lift hand truck.

FIGS. 8 and 9 is the top plant of two sets the post 23, 24, 25. This have the pulleys 27, 29, 77. The black circular in the pulleys is the cable 60 in position to descent.

Figure 10:
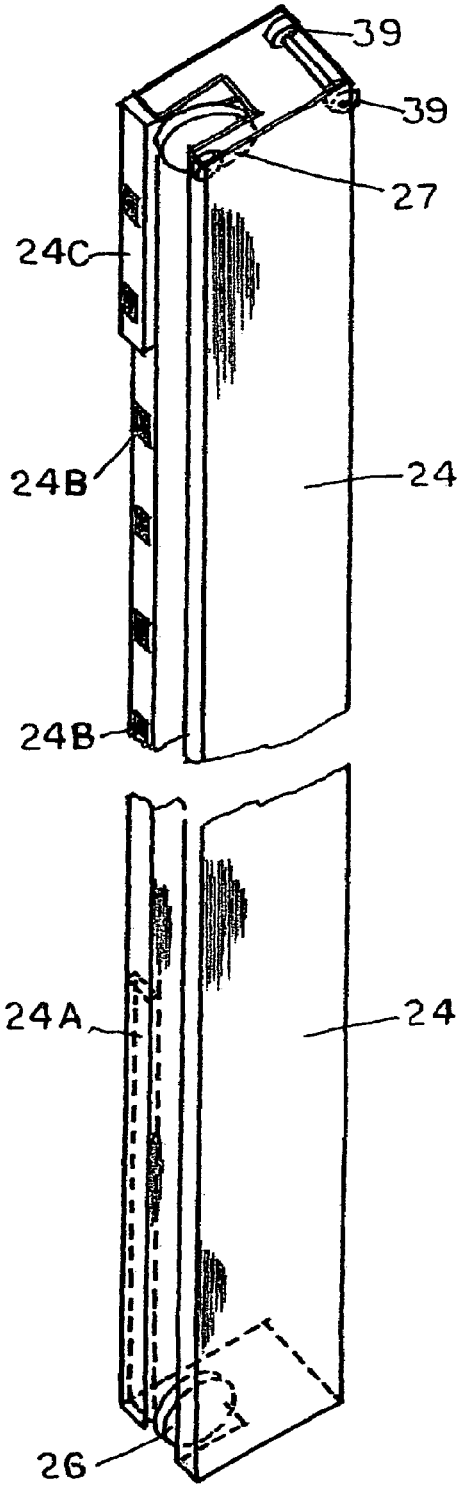
FIG. 10 is a perspective of the second mast of the telescoping lift hand truck.
Figure 13:
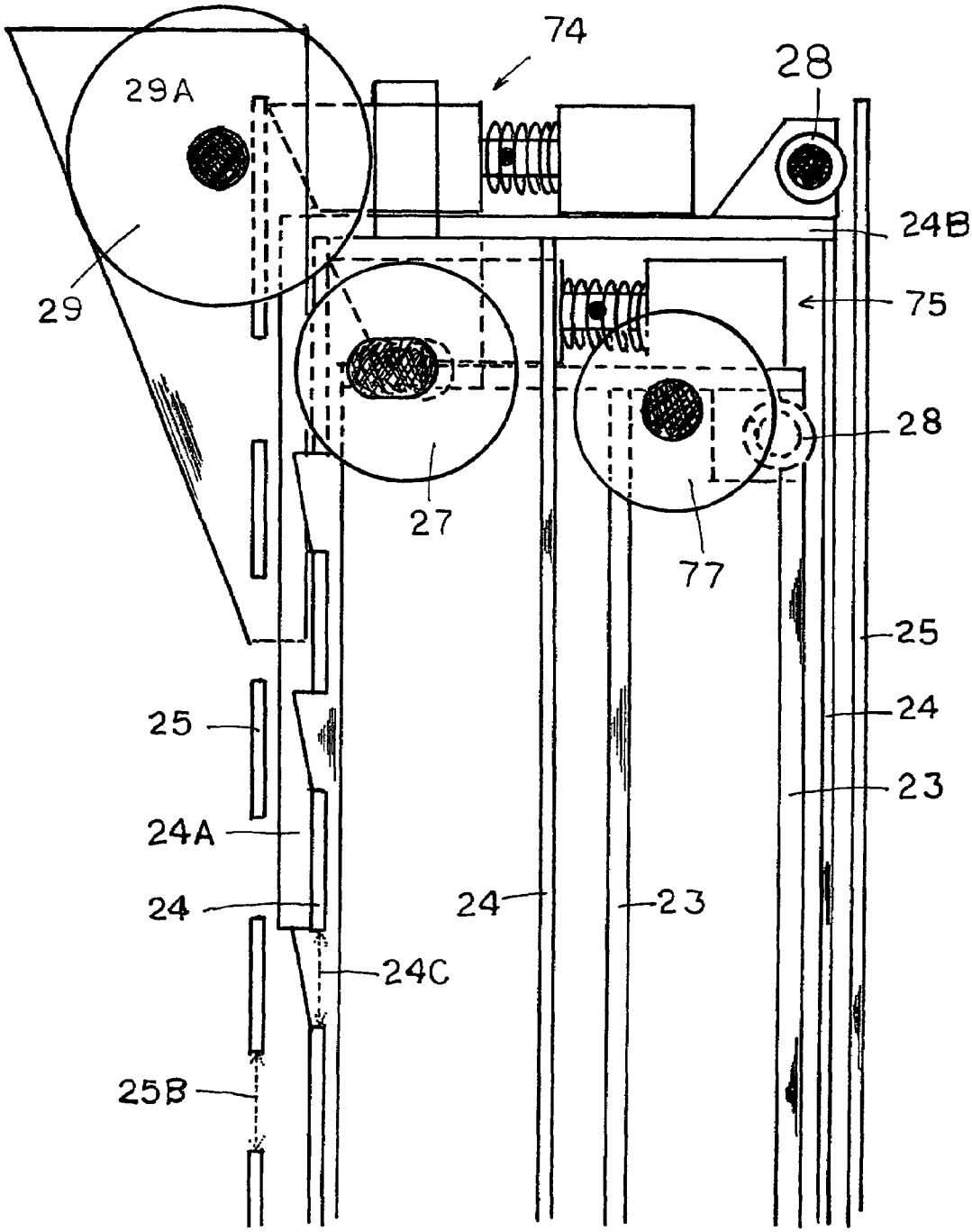
FIG. 13 is a side elevation of the sectional upper of third, second and first mast of telescoping lift hand truck. This is when the machine is in lower position.

FIG. 10 shows second mast movable 24, This have pulley 26 in the lower side and another pulley 27 in upper side, also three bearings in the top 39 and have a piece welding in the top 24C for stop third posts when to bump piece 25A in the third post 25 and use for third mast 25 none go more up and have hole 24 B for security lock 74 this shows in FIG. 13.

The bearings 39 is for to relive to rub shoulders with another third mast 25. This mast 24 have another stop in the lower interior position 24A, This is stop with the stationary mast 23 this mast 23 have one extension in one upper side see in FIG. 12

Figure 11:
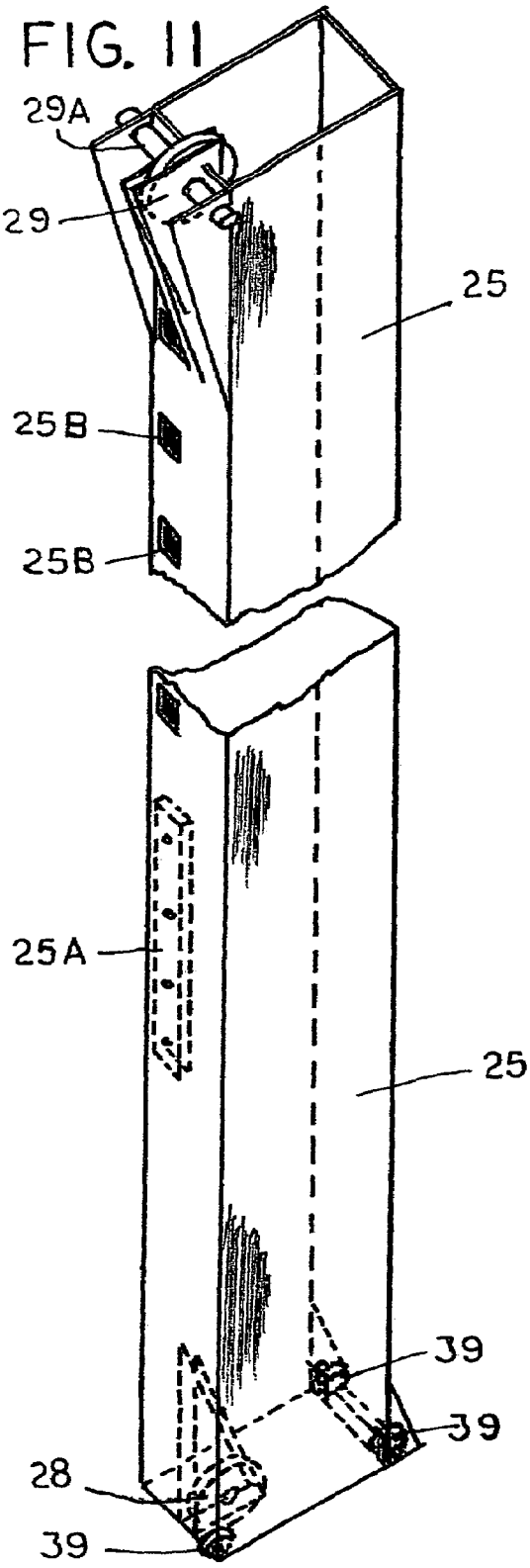
FIG. 11 is a perspective of the third mast of the telescoping lift hand truck.

FIG. 11 shows third movable mast 25. This have pulley 28 in the lower side and another pulley 29 In the upper side, also have three bearing 39 in lower position. The bearing 39 is for to relive to tube shoulders with another mast 24. this mast 25 have another stop 25A in the lower position in interior side, this stop 25A the movable mast 24

The mast 25 have holes in one side 25B for security lock 74 this show in FIG. 13 security lock 74 is over of mast 24

Figure 12:
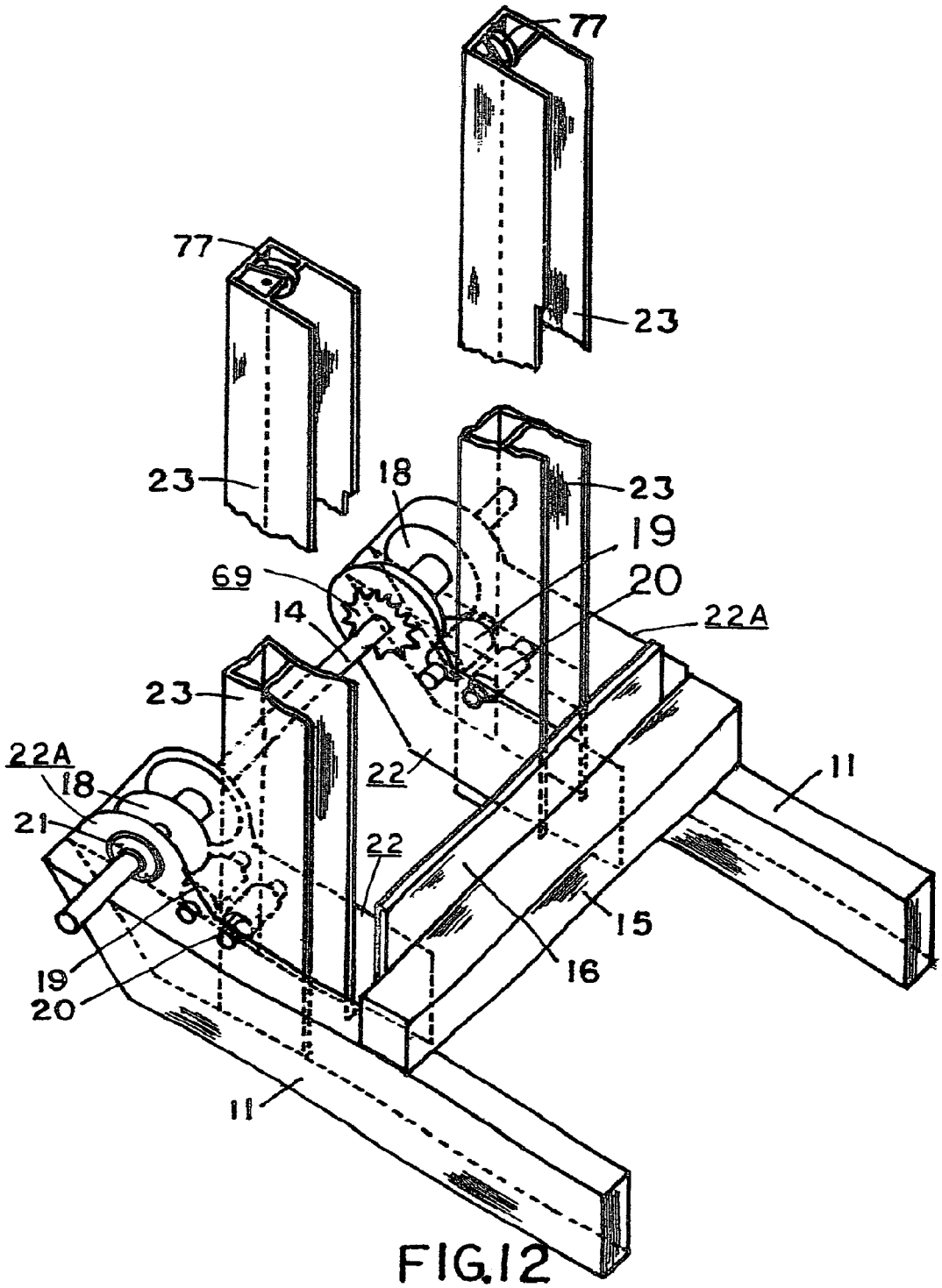
FIG. 12 is a perspective of the base stationary of the telescoping lift hand truck.

FIG. 12 illustrates all base stationary 10 this base 10 have two base side members 11. This two base members 11 is joined for a base cross member 15 and the plate 16 this plate support the motor 66, this show in FIG. 4.

Two base side member 11 support mast 23, this is perpendicular and is welding and is stationary send to the base. This mast have in the lower position interior side one longer bearing 20, That bearing 20 use since pulley, and in the top the mast 23 have one pulley 77 and security lock 75.

This two base member 11 in one extreme united for the axle 14, but the axle is supported by bearings 21, which is supported for two pieces 22, 22A the 22A is welded to the side member 11, also the stationary mast 23, and the vertical plate 16, the piece 22 is welded to the stationary mast 23 and the vertical plate 16, both 22 and 22A have in common the axle 14. This axle 14 have four bearing and two wheels in the ends. The axle have two cables reel 18 in the front the stationary mast 23.

Between the cable reel 18 and the lower bearing 20 of the mast 23 have another bearing 19. The axle have chain wheel 69, this are connected to the motor 66 and the chain 68 as showing in FIG. 4.

FIG. 13 The tap portion when the machine is in the lower position, here have three mast 23, 24, 25 and have the pulleys 27, 29, 77 the security lock 74, 75 the bearing 28 to prevent shoulders.

Figure 14:
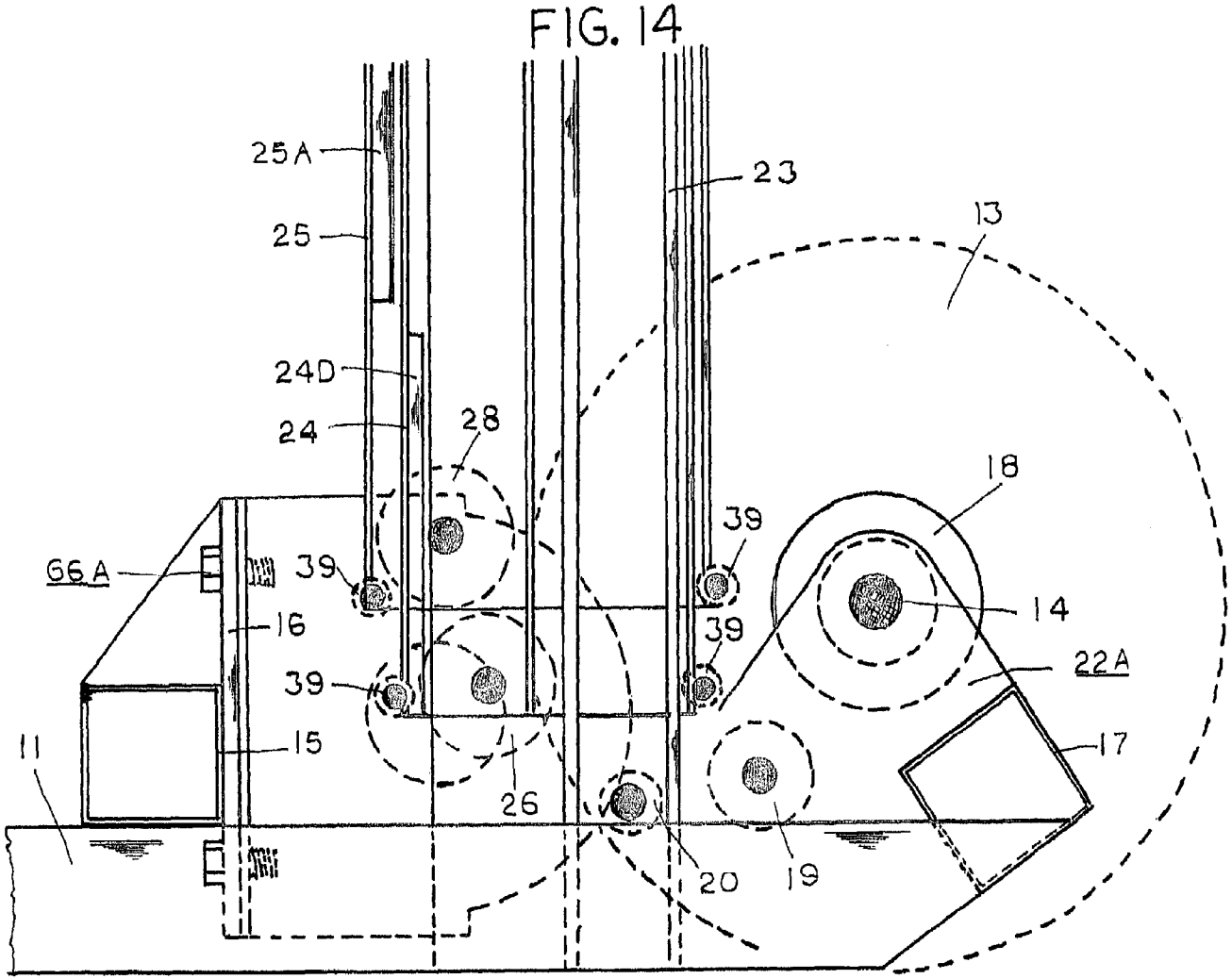
FIG. 14 is a side elevation the sectional lower of third, second and first mast of the telescoping lift hand truck, this is when the machine is in power position.

FIG. 14 The lower portion when the machine is in the lower position, here have three mast 23, 24,25 have the pulleys 26, 28, 20, 19 have the wheels 13 and the bearing 39 to prevent shoulders.

FIG. 15 illustrates the bar 59 this bar is rectangular tub, that have two part 61, 62 the bar more broad 61 and less broad 62 this be inside on 61. If the machine is closed to the wall the bar less 62 is adjustable. The bar more broad 61 have two pieces welding, this pieces 63 inside on the long bar 12

FIG. 16 illustrates the rectangular tube 67, 67A for stabilized machine and that inside in the cross rectangular tube 15 this rectangular tube 67A inside in the rectangular tube 67

Figure 17:
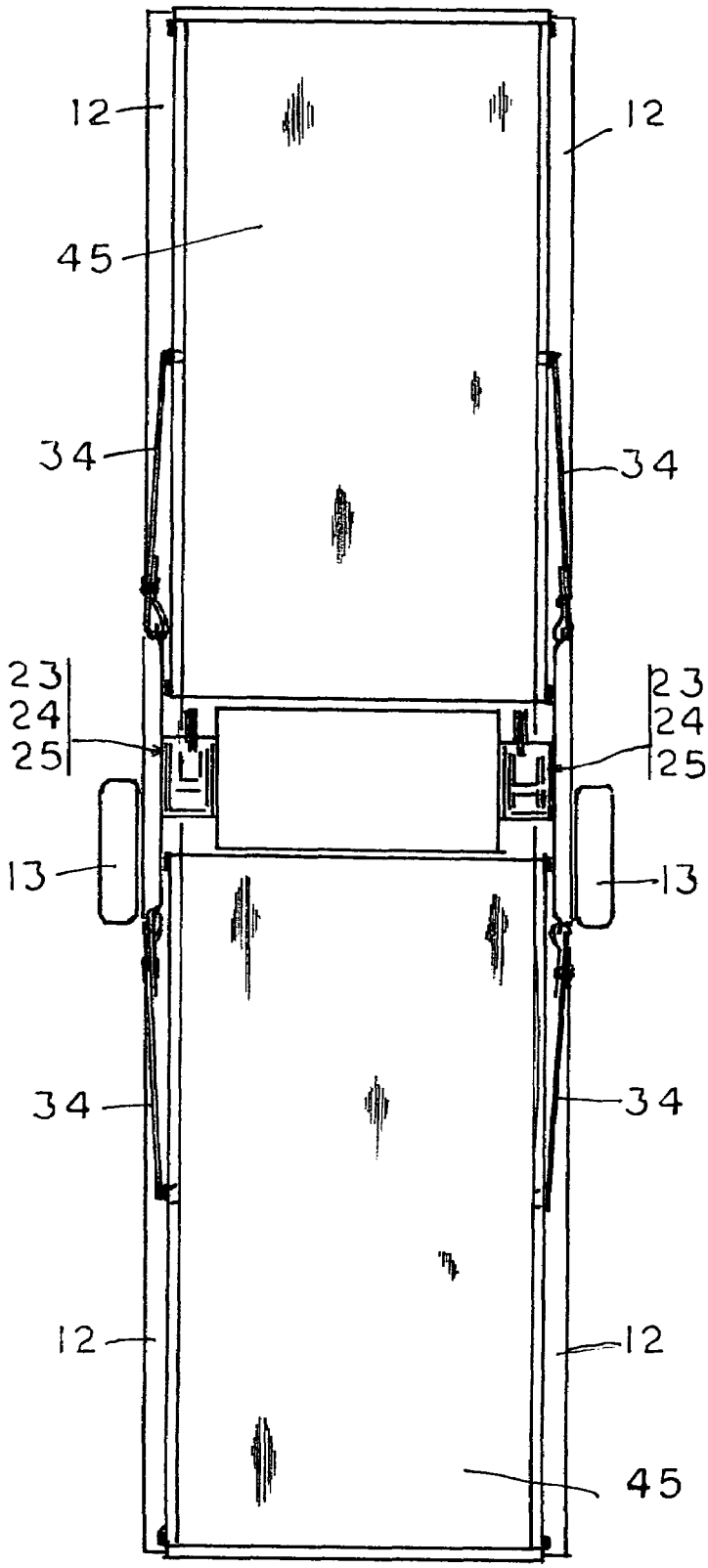
FIG. 17 is a top plan view of the telescoping lift hand truck when no have railing

FIG. 17 show top plant of the machine in position lower before assembly.

Figure 18:
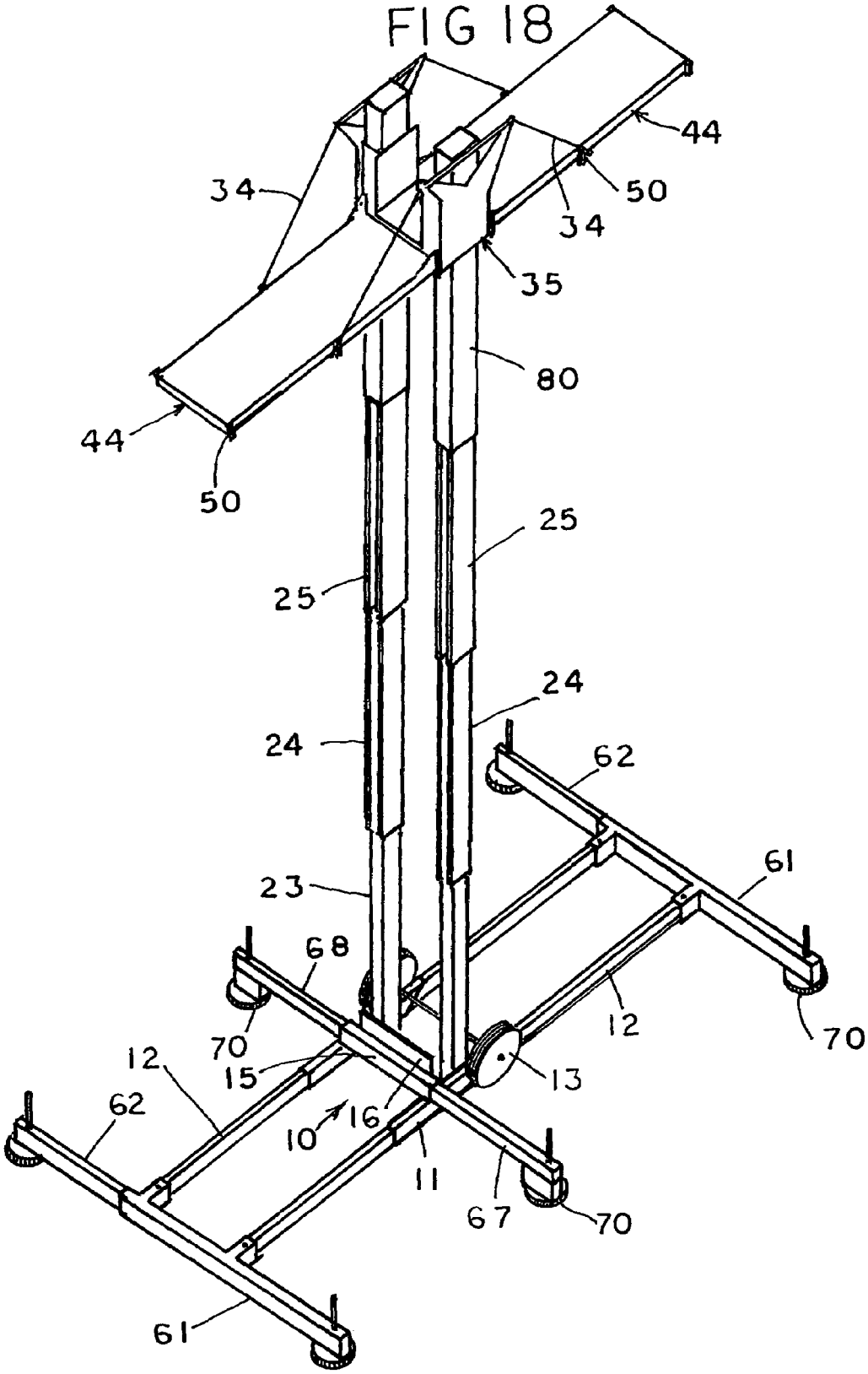
FIG. 18 is a perspective view of telescoping hand truck this have four pair of vertical posts and no have railing

FIG. 18 show is same FIG. 1 more safety for stability and fourth mast

Figure 2:
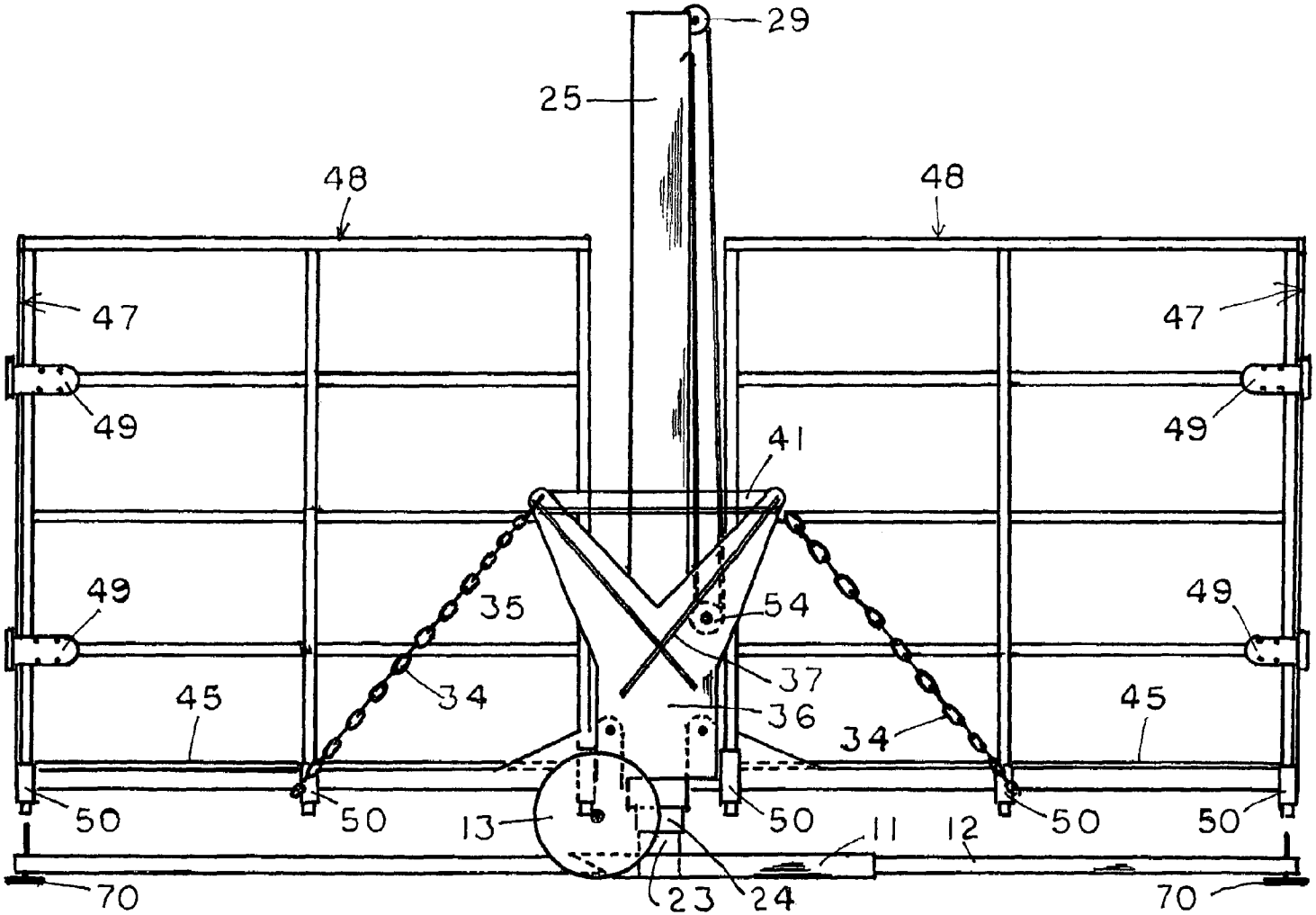
FIG. 2 is a side elevational view of the telescoping lift hand truck shown in lowered position.

FIG. 1 is the machine at his maximum raising position and FIG. 2 is the lowering position when a worker is on the platform 44 he can easily used the controlled to raising and lowering.

The motor 66 move the chain 68, the chain 68 move chain wheel 69, the chain wheel 69 is fixed in the axle 14, the axle 14 move two cable reel 18, the cable 54 is to coil in the cable reel 18, this cable 54 to pass for two bearing 19, 20, the cable 54 to continue upward to the pulley 77 and continue downward and connect to the pulley 26, the cable 54 to continue up ward to the pulley 27 the second mast 24, the cable 54 continues downwardly to the lower pulley 28 and upwardly to the pulley 29 belonging at the third mast 25, the cable 54 lowering to the pulley 72 the movable platform base 35 and the cable 54 continues to the upper side of the third mast 25 the cable 54 is fixed in the upper of the third mast 25. When the motor 66 star of cable 54 going for all bearing and pulley before said, and the dist enter the platform and the upper pulley 29 of the third must 25 is reduce afterwards the platform 45 to raise, when the base 35 go to the maxim raising have one stop, after this stop star to raising third mast 25 when said mast 25 go to the maxim raising have another stop and star to raising another second mast 24, when said second mast 24 stop in the maxim upper position of the machine, this explain FIG. 1

While the invention herein disclosed has been described by means of specific embodiments an applications thereof, numerous modifications an variations could be made thereto by those skilled in the art with out departing from the scope of the invention defined in the appended claims.

I claim:

1. A lifting hand truck comprising:

a pair of parallel rectangular tubular member, spaced horizontally from each other by a tubular cross member extending between and welded directly to the tops of the pair of parallel members;

wherein each of the pair of parallel members further comprise a telescoping portion such that the parallel members may be extended longitudinally, and wherein the cross member further comprises a first telescoping arm within the cross member and a second telescoping arm within the first telescoping arm, each of the first and second telescoping arms extending outwardly from opposite ends of the cross member;

the pair of parallel members further comprising a telescoping stabilizing bar coupled to each end of the pair of parallel members, wherein each of the telescoping stabilizing bars include a leveling foot attached to each end of the telescoping bars;

a vertical plate welded directly to the cross member and a motor secured directly to the vertical plate;

a first pair of vertical posts connected to the pair of parallel rectangular tubular members; wherein one of the vertical posts of the pair is welded to one of the pair of parallel rectangular tubular members, and the other of the vertical posts is welded to the other of the parallel rectangular tubular members;

a second pair of vertical posts, slidably coupled to the outside of the first pair of vertical posts;

a third pair of vertical posts, slidably coupled to the outside of the second pair of vertical posts;

a fourth, uppermost, pair of vertical posts, slidably coupled to the outside of the third pair of vertical posts;

each of the posts of the first, second, third and fourth pairs of vertical posts having a unshaped cross section such that the second posts are fitted around the first posts and the fourth posts are fitted around the third posts which are fitted around the second posts;

wherein the pairs of posts are slidably operated by a plurality of pulleys and cables attached to the inside of the vertical posts and coupled to connecting sprockets and axle of the motor;

the first, second and third pairs of vertical posts each having blocks disposed on the upper portions of their outer surfaces of the pairs of posts, the blocks acting as stops when internal blocks that are disposed on the internal surfaces of the lower portions of the second, third and fourth pairs of vertical posts respectively are slid upwardly and abut against the externally disposed blocks, limiting the extension of the posts;

a first main rectangular platform extending between the fourth pair of vertical posts; each of the uppermost posts having a Y-shaped bracket attached thereto; each of the Y-shaped brackets further comprising a lower portion extending vertically and two upper portions extending upward and away from each other so as to form a Y-shape, each of the Y-shaped brackets comprising a pair of pivot pins on their lowermost portions, and a pair of shackles on their uppermost portions;

a second rectangular platform pivotally connected by the pivot pins to the bottom portion of the Y-shaped brackets on one side of the first main platform; and a third rectangular platform pivotally connected by the remaining pivot pins to the bottom portion of the Y-shaped brackets on the other side of the first main platform opposite the second platform such that the first main platform has one pivotally connected platform on either side;

each of the Y-shaped brackets further comprising supporting chains that extend from the shackles on the uppermost portions of the Y-shaped brackets, downward to the midpoints of the second and third rectangular platforms; and wherein the second and third rectangular platforms further comprise modular, collapsible railings; the modular collapsible railings being connectable to three sides each of the second and third platforms by a plurality of hinge brackets.

* * * * *